US005332155A

United States Patent [19]

Jäger

[11] Patent Number: 5,332,155

[45] Date of Patent: Jul. 26, 1994

[54] ROTOR NOZZLE FOR HIGH PRESSURE CLEANING APPARATUS

[76] Inventor: Anton Jäger, Krautgartenweg 12, D-7913 Senden/Hittistetten, Fed. Rep. of Germany

[21] Appl. No.: 37,616

[22] Filed: Mar. 25, 1993

[30] Foreign Application Priority Data

Mar. 28, 1992 [DE] Fed. Rep. of Germany ..... 4210239
Nov. 25, 1992 [DE] Fed. Rep. of Germany ..... 4239542

[51] Int. Cl.[5] ..... B05B 3/04
[52] U.S. Cl. ..... 239/240; 239/237; 239/263; 239/264; 239/381
[58] Field of Search ..... 239/237, 240, 263, 264, 239/380, 381, 382, 383

[56] References Cited

U.S. PATENT DOCUMENTS 4,708,290 11/1987 Osmond ..... 239/240 X
4,802,628 2/1989 Dautel et al. ..... 239/240 X
4,989,786 2/1991 Kränzle et al. ..... 239/240
5,108,035 4/1992 Friedrichs ..... 239/240 X
5,217,166 6/1993 Schulze et al. ..... 239/263 X

FOREIGN PATENT DOCUMENTS 3915962 9/1990 Fed. Rep. of Germany ..... 239/240

*Primary Examiner*—Andres Kashnikow
*Assistant Examiner*—William Grant
*Attorney, Agent, or Firm*—Herbert Dubno

[57] ABSTRACT

A rotor nozzle assembly has its nozzle rigidly fixed in the rotor body which is journaled at one side in a two-part housing which can be opened for replacement of the rotor body and nozzle as a unit.

24 Claims, 10 Drawing Sheets

ROTOR NOZZLE FOR HIGH PRESSURE CLEANING APPARATUS

FIELD OF THE INVENTION

My present invention relates to a rotor nozzle for a high pressure cleaning apparatus and, more particularly, to a nozzle for a high velocity water jet cleaning apparatus or an apparatus utilizing jets of other cleaning liquids which are caused to orbit an axis of the nozzle. More particularly, the invention relates to a nozzle for a high pressure cleaning apparatus having a rotatable body which is driven at least in part by the cleaning liquid dispensed therefrom.

BACKGROUND OF THE INVENTION

European patent publication 0 252 261, for example, discloses a rotary nozzle for a high pressure cleaning apparatus which comprises a nozzle housing in which a rotor body is journaled for rotation about an axis of the housing, i.e. is axially rotatable, and is set in rotation by the cleaning liquid flowing through the nozzle housing. Downstream of the rotary body or rotor, a nozzle is provided whose ends turned toward the outlet orifice of the nozzle housing is supported in a pocket bearing on the nozzle housing and has a discharge axis including an acute angle with the rotation axis of the rotor, whereby the discharged jet has a conical configuration surrounding the rotation axis as the rotor is propelled within the housing.

This rotor nozzle assembly has a rotor formed with a cup serving as an entrainer for the rotor and in which the nozzle itself extends at its end remote from the end engaging the pocket bearing. This system has the drawback that, should replacement of the rotor body or of the nozzle be necessary or desirable as a consequence of wear or for substitution of another nozzle or rotor body matched to particular applications of the apparatus, such replacement or exchange is rendered difficult by the manner in which the rotor body is mounted. For example, replacement requires that the nozzle end be fitted into the entrainer cup.

Furthermore, with this construction, sealing elements and bearing locations must be provided at the driving side of the rotor body. Such elements are highly sensitive to contaminants in the cleaning liquid and are thus subject to early failure.

Moreover, adjustment of the speed or the setting of the speed is not normally possible and the maximum angle of the spray cone is greatly limited.

Finally, since the inlet side of the nozzle is surrounded by free space, the cleaning liquid tends to become turbulent in this region and the flow through the nozzle tends to become highly turbulent, creating problems in the effect of delivery of the liquid.

OBJECTS OF THE INVENTION

It is, therefore, the principal object of the present invention to provide a rotor nozzle assembly for high pressure cleaning apparatus which is user-friendly with respect to maintenance and replacement of the rotor body and the nozzle, has a higher useful life, i.e. is less subject to wear and problems deriving from the presence of contaminants in the cleaning liquid, which can facilitate the exchange or replacement of the rotor body and/or the nozzle, and can be maintained by nonprofessional personnel.

Another object of this invention is to provide an improved rotary nozzle for the purposes described which is of comparatively low cost and is less sensitive to the presence of contaminants in the cleaning liquid than earlier systems.

It is also an object of this invention to provide an improved rotary nozzle which will overcome drawbacks of earlier systems and, especially, can allow replacement of the rotor body and nozzle and a measure of control of the rotary speed.

SUMMARY OF THE INVENTION

These objects are achieved, in accordance with the invention, in a rotary nozzle assembly for a high pressure cleaning apparatus which comprises:

a nozzle housing defining a rotation axis, an outlet orifice along the axis at one end of the housing, and an inlet for a cleaning liquid at an opposite end of the housing;

a rotor body in the housing rotatable about the axis;

an elongated nozzle rigidly fixed in the rotor body and having an outlet end proximal to the orifice and an inlet end communicating with the inlet and remote from the orifice, the nozzle being oriented at an acute angle to the axis to generate a jet emerging from the orifice with a conical configuration upon rotation of the rotor body about the axis;

a pocket bearing in the housing surrounding the orifice, the outlet end of the nozzle engaging the pocket bearing; and means in the housing for journaling the rotor body on a part of the housing opposite the orifice in a one-sided journal.

More particularly, the invention provides that the nozzle is rigidly mounted in the rotor body and that the rotor body is journaled at one side only at the side thereof opposite that at which the nozzle discharges, i.e. at a side of the rotor body spaced from the pocket bearing at which the nozzle engages the assembly housing.

The invention thus has the advantage that the nozzle housing need be openable only at its end opposite the end provided with the nozzle orifice to enable the rotor body together with the nozzle to be withdrawn and through which the replacement rotor body and nozzle can be inserted as a unit.

The nozzle housing, after insertion of the rotor and the nozzle which is rigid therewith, can then be closed without requiring any time-consuming or complex adjustment or positioning. This construction allows a significantly larger cone angle of the jet in a more compact construction of the nozzle assembly, the compact construction affording greater insensitivity with respect to contamination of the cleaning liquid.

In a preferred embodiment of the invention, the rotor is journaled on the nozzle housing on an axially-extending stub or pin. The axial stub is preferably formed or provided on the cover part of the nozzle housing. Alternatively, it is possible according to the invention to provide the journaling stub or pin so that it is fixed to or rigid with a deflecting element which itself is fixed on the cover part of the nozzle housing and is provided with flow passages for the cleaning liquid extending from the inlet opening on the nozzle housing.

The axially-extending journaling pin or stub can have a bore coaxial therewith and communicating with the inlet opening. The end of this bore extending into the rotor body can communicate with a tube segment embedded in the rotor body. The segment can extend initially axially in the rotor to receive the cleaning liquid from the bore in the pin and then can extend radially outwardly to terminate in a tangential mouth. As a consequence, the flow of cleaning liquid is emitted tangentially from the body and the tube segment converts the axial flow of cleaning liquid into a tangential discharge to create a reaction force which propels the rotor body round its axis. The tubular segment can be injection molded in the rotor body, cast therein or clamped or swaged in the rotor.

When the journaling pin or stub is a cylindrical pin, it can be received in a cylindrical bore or hole in the rotor. Alternatively, the pin can taper conically toward this free end to provide a self-centering engagement of this pin in a correspondingly conically-shaped seat of the rotor. The sleeve-centering construction facilitates the application of the housing cover when the housing is to be closed.

According to another feature of the invention, a turbine wheel is provided in the housing and is traversed by the cleaning liquid. The rotor can then be formed with rollers engaging an annular surface of the turbine wheel and the rollers, in turn, can ride on an annular race of the housing.

In this case, the rollers provide a step-down transmission between the turbine wheel and the rotor in which the nozzle is fixed. This embodiment has been found to be effective when a reduced speed of the rotor is desirable, i.e. the speed with which the emerging jet orbits the axis of rotation is to be limited.

The rollers, in turn, can be received in recesses or cut-outs in the rotor or the rotor can be provided with radial arms on which the rollers are journaled.

A bearing ring can be mounted in the housing to form the other race for the rollers opposite the turbine wheel and this ring can have properties which are matched to the materials from the rollers which are constituted to minimize wear.

The turbine wheel can be journaled on an axial shaft of the nozzle assembly housing and this shaft can be made of a length sufficient to extend into the rotor and thus provide the journal for the rotor.

The turbine wheel can be biased toward the rotor and hence the rollers by a coil spring received in the housing and bearing axially upon the turbine wheel.

The rotor body can extend substantially over the entire length of the interior of the housing in the axial direction. In this manner, I am able to provide a sufficiently long receptacle for the nozzle and the nozzle itself can be received in a cylindrical bore of the rotor and can be formed from a sleeve or tube which is provided with a nozzle point at one end while at its other end is formed with guide vanes which limit turbulence in the liquid entering the nozzle and ensure a laminar flow of the liquid therein.

To minimize wear, in the region between the pocket bearing and the journaling pin, a spring member or element or other resilient structure is provided to damp the axial play of the rotor. This resilient means can be formed by a coil spring which can be disposed between the bottom of the housing in a region formed with the pocket bearing and engaging the end face of the rotor body outwardly of the nozzle tip. The resilient means can also be formed by an elastic ring or an elastic washer can be disposed between a radially outwardly extending annular flange on the sleeve part and the end face of the rotor turned toward the outlet orifice of the nozzle housing.

It is also possible, in accordance with the invention to provide the pocket bearing in an axially adjustable screw threaded insert at the corresponding end of the nozzle housing. This enables an adjustment of the position of the rotor body in the axial direction of the nozzle housing and is especially effective when the nozzle housing can be opened at its opposite side from the outlet orifice for maintenance of rotor replacement.

Finally, the nozzle housing along its inner wall can be provided with an annular surface tapering toward the outlet orifice while the rotor body can have an annular projection juxtaposed with this surface so that between the annular surface and the annular projection, an annular gap is provided and with a width which is a function of the axial position of the rotor body.

This provides a floating bearing or journaling of the rotor body with an equilibrium established between the leakage liquid flowing through the gap with the pressures on opposite sides thereof. The annular projection can have an axially extending cutout or notch in its periphery which will permit the passage of dirt particles.

BRIEF DESCRIPTION OF THE DRAWING

The above and other objects, features, and advantages will become more readily apparent from the following, reference being made to the accompanying drawing in which.

SPECIFIC DESCRIPTION

Figure 1A:
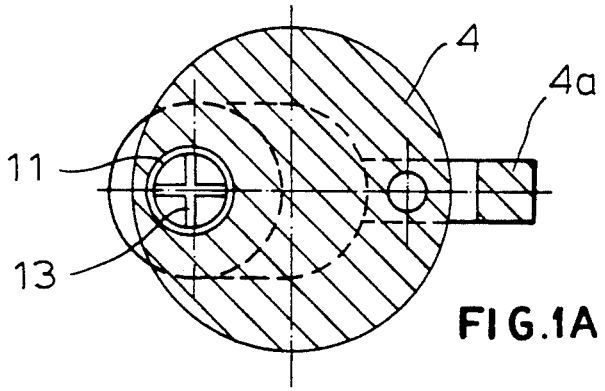
FIG. 1A is a cross sectional view taken along the line IA—IA of FIG. 1.

The rotary nozzle assemblies shown in the drawing are connectable to a high-pressure pump, for example, a high pressure hose or wand forming part of the apparatus for high-pressure cleaning.

Throughout the drawing, similarly functioning elements are designated with similar reference numerals.

The basic elements in all cases include a housing 1 having an inlet 2 connected to the source of high-pressure cleaning liquid. Opposite the inlet 2 is an outlet orifice 3 from which the respective jet is trained upon the object or articles to be cleaned.

Within the housing there is at least one rotor body 4 rotatable about the axis of the housing and axially journaled therein. The liquid flows from the inlet to the outlet past the rotor body 3 which is driven by the cleaning liquid. For example, the rotor body can be formed along its periphery with vanes which are inclined to the flow direction to form turbine blades as is the case in the embodiments of FIGS. 3 and 6.

Alternatively, propulsion of the rotor body can utilize the reaction principle in which all or part of the cleaning liquid is directed out of a passage, e.g. tangentially, after passing the rotor body fully or partially so that the reaction forces will rotate the rotor body. The ejection of the liquid can thus be effected in a plane perpendicular to the axis and inclined to the radial direction (see FIGS. 2, 4 and 5).

Figure 1:
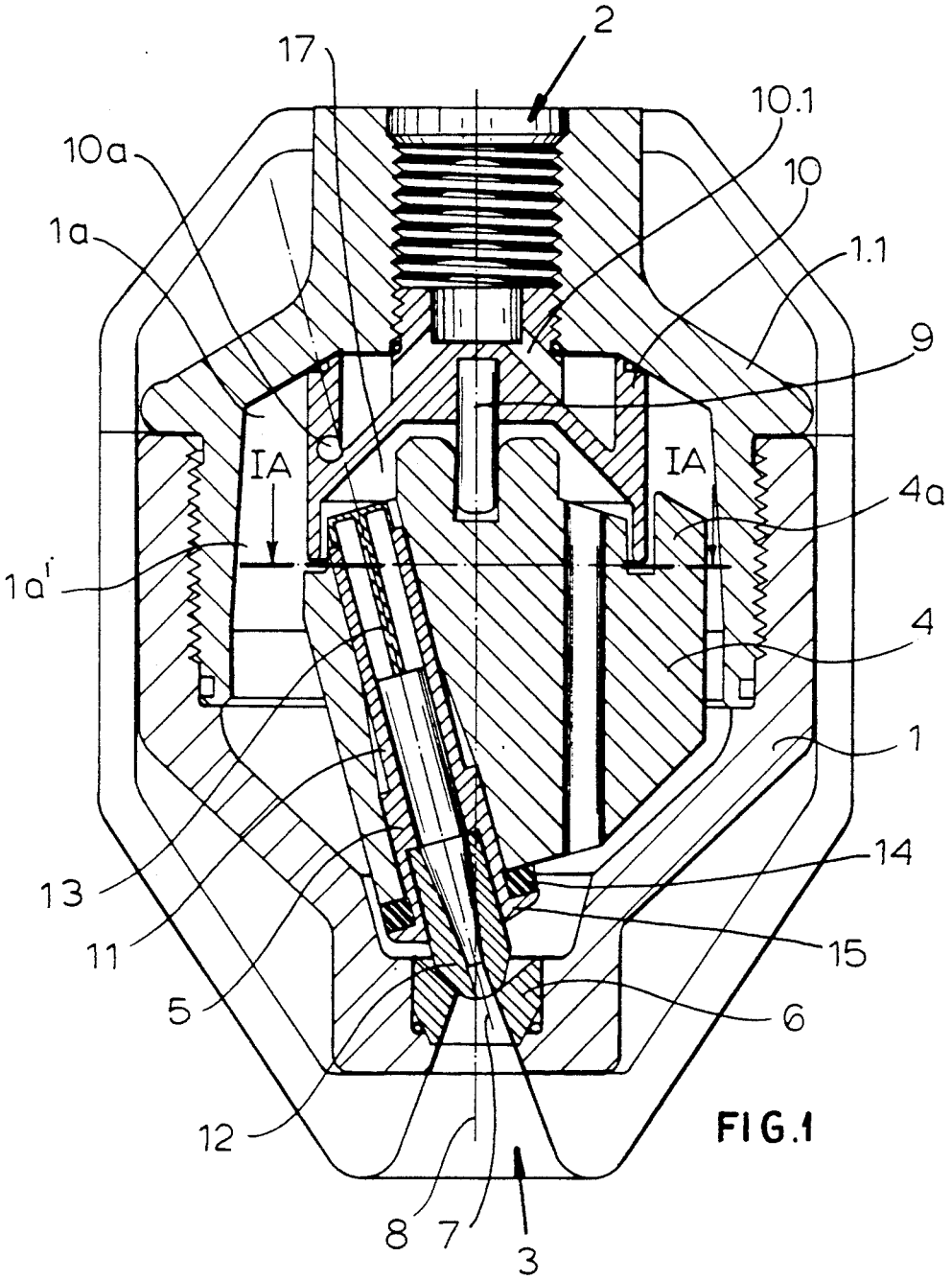
FIG. 1 is an axial cross sectional view through a rotary nozzle assembly according to the invention.
Figure 7A:
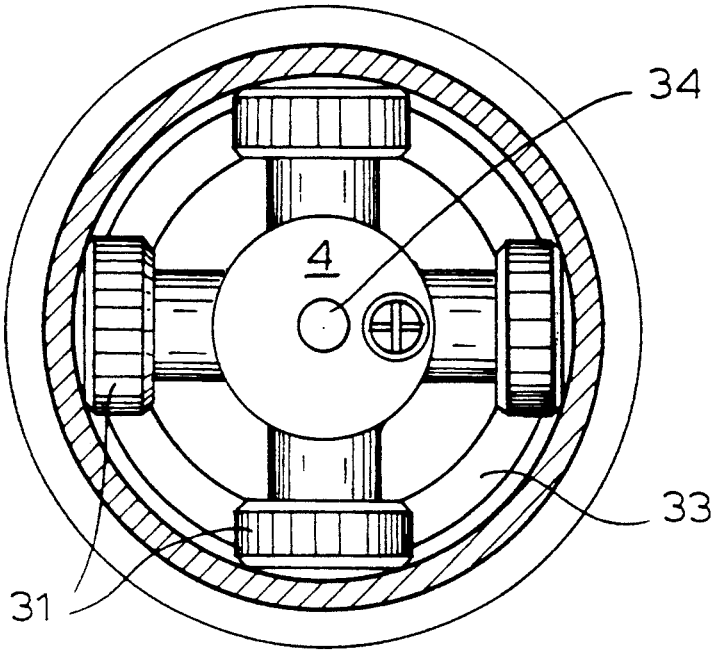
FIG. 7A is a cross sectional view generally along the line VIIA—VIIA of FIG. 7.

The rotor body may also be propelled, as the case with the embodiment of FIG. 1, by the vortex principle. In this operation, the vortex of the cleaning liquid is established in a chamber 1*a* of the housing surrounding the rotary body by a tangential outlet 10*a* in a deflector 10 receiving the cleaning liquid from the inlet 2 via passages 10.1 in the cleaning body. The rotor body 4 is not of circular cross section as will be apparent so that it is entrained with the vortex generated in the chamber 1*a*.

Downstream of the inlet 2 in the housing 1, an elongated nozzle 5 is provided. The nozzle 5 has an outlet end which can be formed with a tip 12 and is received in a pocket bearing 6 braced in or supported by the nozzle housing 1. The discharge axis 7 of the nozzle 5 is at an acute angle to the rotation axis 8 of the rotor body so that, upon rotation of this body 4, the outflow from the nozzle is a conical jet rotating about the axis 8.

In all of the embodiments illustrated, the nozzle 5 is rigidly mounted in the rotor body 4 while the rotor body 4 is journaled at one side via, for example, an axial stub or pin 9 on the nozzle housing 1 at its side opposite the orifice 3.

As can be seen from FIGS. 1 and 1A, the tangential bore 10A opens into the vortex chamber 1*a* above the downstream end 1*a'* turned toward the outlet 3 so that a free circular flow of the liquid is possible in the region of chamber 1*a* directly surrounding the portion of the sleeve 10 provided with the tangential bore 10*a*.

Reaching into this vortex chamber 1*a* axially is a projection 4*a* of the body 4 which forms a vane which is entrained in circular movement about the axis 8 by the swirl of liquid in the vortex chamber.

The projection 4*a* does not extend the full axial height of the vortex chamber 1*a* but only extends into the downstream portion 1*a'* thereof. The vane 4*a* in combination with the vortex chamber 1*a* constitutes the means for driving the rotor body 4 about the axis 8.

Figure 2A:
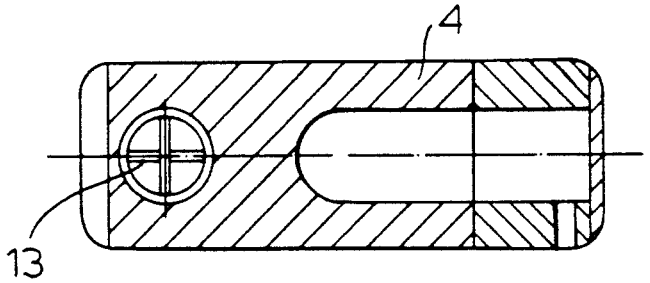
FIG. 2A is a section taken along the line IIA—IIA of FIG. 2.
Figure 2:
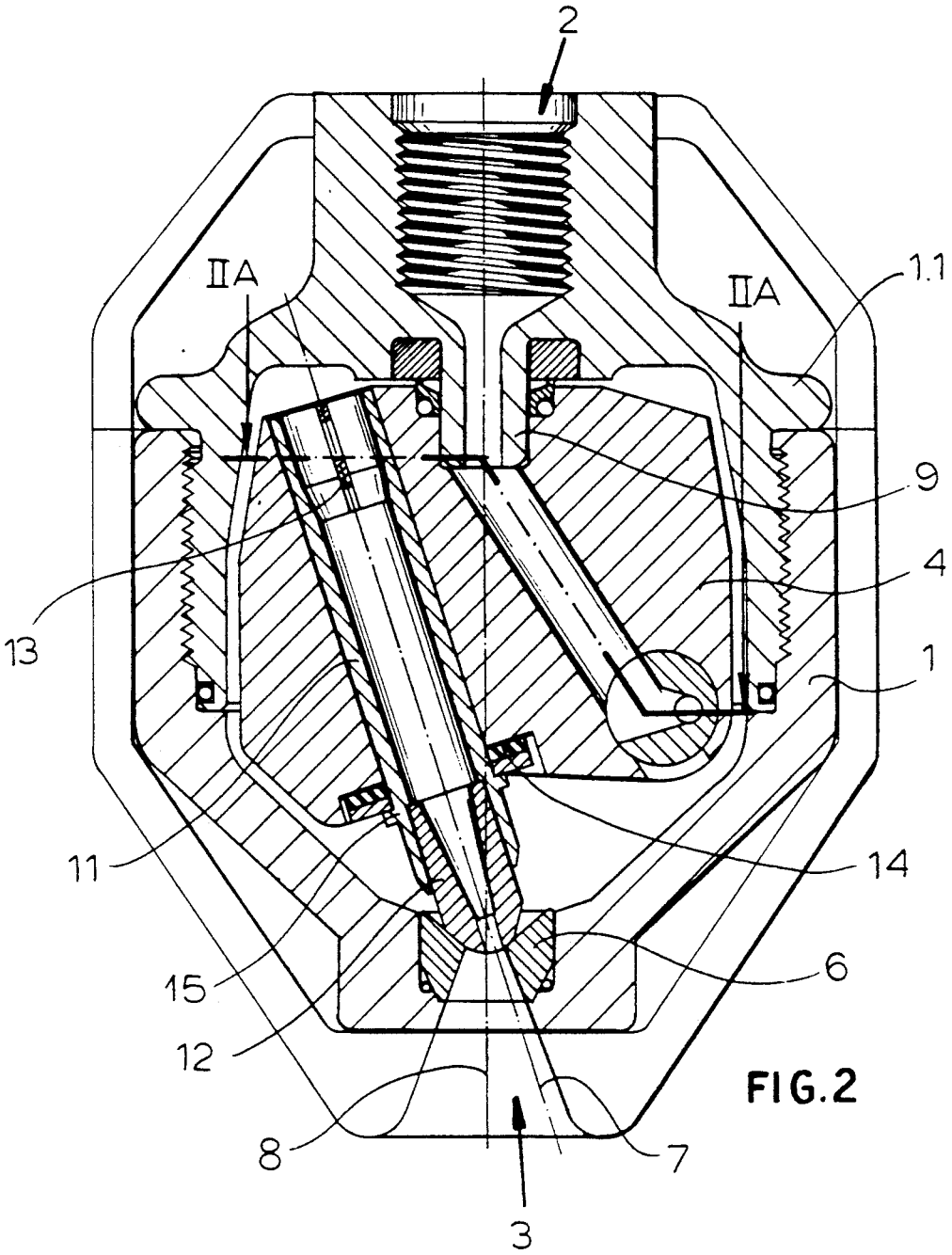
FIG. 2 is an axial section through another embodiment of the invention.
Figure 3A:
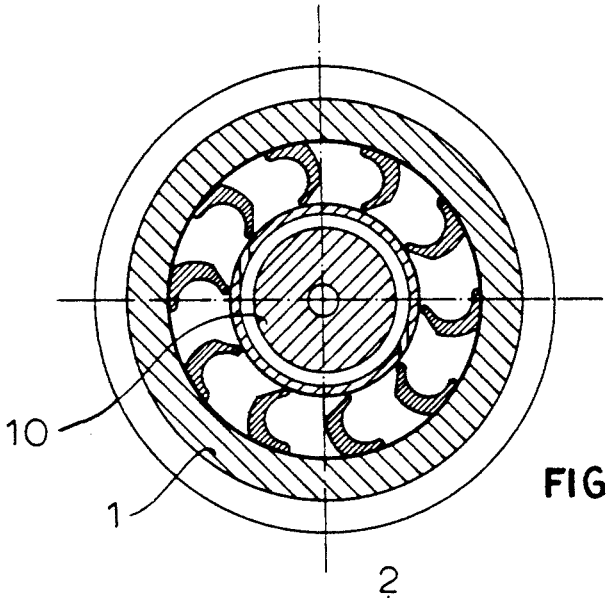
FIG. 3A is a cross sectional view taken along the line IIIA—IIIA of FIG. 3.
Figure 3:
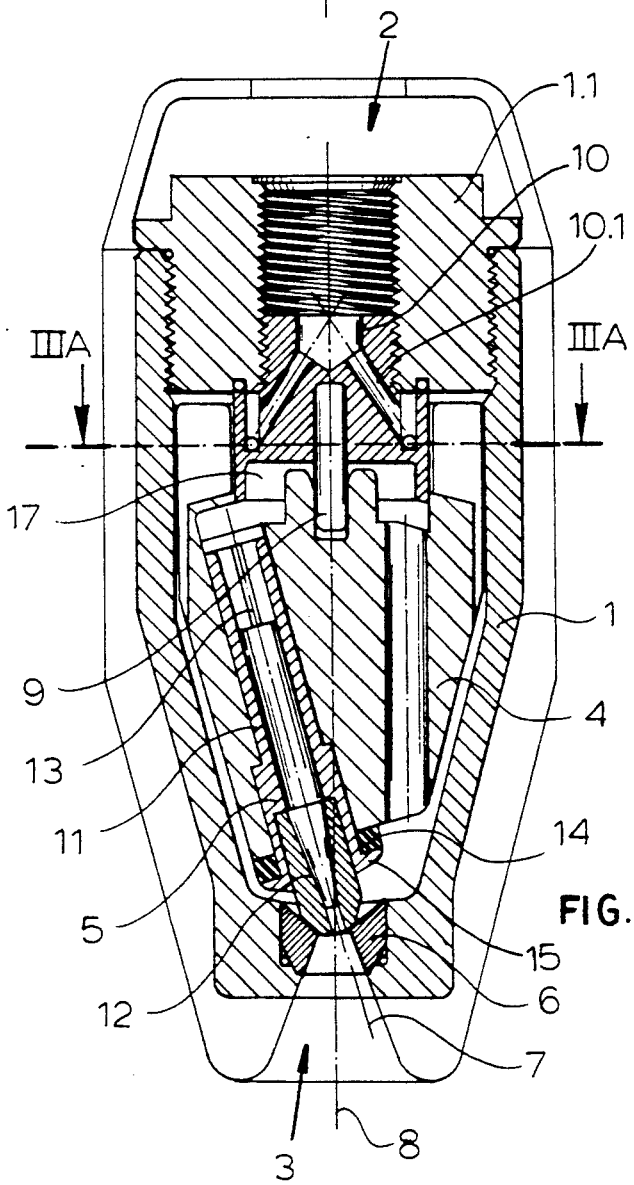
FIG. 3 is an axial section through still another embodiment of the invention.

In the embodiment of FIG. 2, the axial stub 9 is fitted directly on the cover member 1.1 of the nozzle housing 1. In the embodiments of FIGS. 1 and 3, the axial stub 9 is mounted upon a deflecting element 10 which is fixed to the cover part 1.1 of the housing 1 and is provided with flow passages 10.1 for the cleaning liquid emerging from the inlet opening 2 into the housing 1.

Figure 1B:
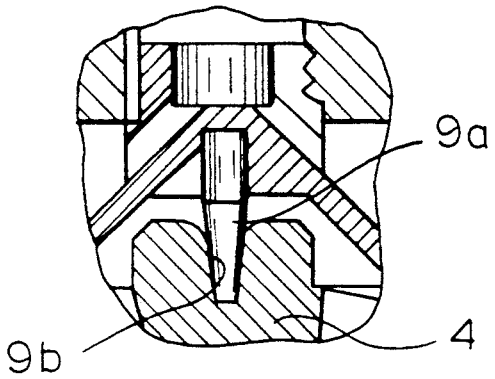
FIG. 1B is a detail view of the journal for the rotor body of FIG. 1 but illustrating another embodiment thereof.

As can be seen from the drawing (see especially FIGS. 1–3), the axial stub 9 can be a cylindrical pin. In FIG. 1*b*, however, the pin 9*a* has a conical shape and is received in a conical seat 9*b* of the rotary body 4. This provides a sleeve centering action upon closing of the housing by screwing the cover 1.1, for example, into the remainder of the housing 1.

Figure 4:
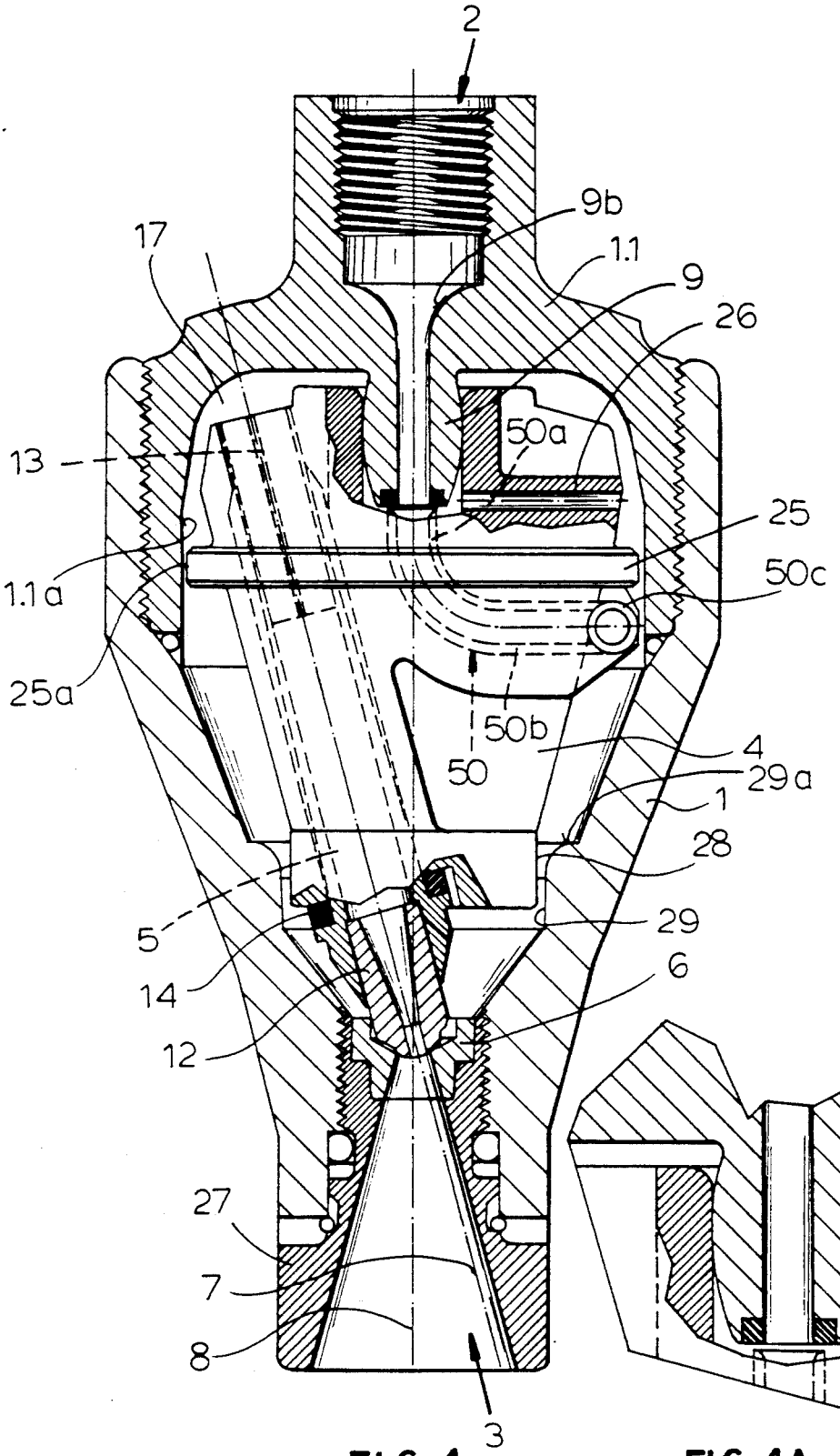
FIG. 4 is an axial section through still another embodiment of a rotary nozzle assembly according to the invention.
Figure 4A:
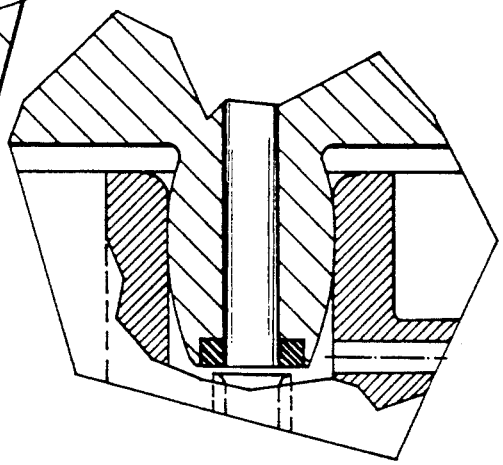
FIG. 4A is a detail view thereof.

In FIG. 4, the axial stub 9 has a bulged shape which also provides a measure of self-centering.

As the drawing also shows, the rotor body 4 extends in axial direction substantially over the whole length of the interior of the housing 1 and thus provides a satisfactorily long accommodation for the nozzle 5.

The nozzle 5 is located in a cylindrical bore of the rotor body 4 and an annular shoulder of this bore (see FIG. 3) or a conical transition region as in FIG. 1, can be provided to engage the nozzle 5.

The nozzle 5 consists in general of a sleeve part 11, one end of which is provided with a nozzle tip 12 while the other end receives vanes 13 ensuring laminar flow into the nozzle.

In the region between the pocket bearing 6 and the axial journal 9, the axial play of the rotor body 4 may be damped by a resilient element 14 which can be variously disposed. It may, for example, be formed by a coil spring braced between the bottom of the housing 1 surrounding the pocket bearing 6 and a juxtaposed end of the rotor body 4 around the tip 12. The resilient member 14 can also be an elastic ring or an elastic washer which can be provided between a rotary outwardly-extending projection 15 on the sleeve 11 and the end of the rotor body 4 turned toward the orifice 3 (see FIG. 1). In FIG. 2 the resilient element is shown as a washer.

Figure 5A:
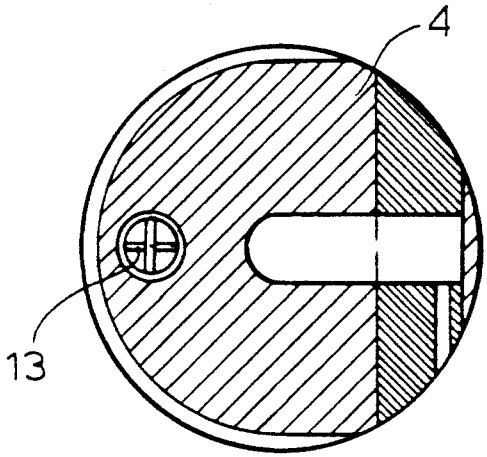
FIG. 5A is a cross sectional view taken along the line VA—VA of FIG. 5.
Figure 5:
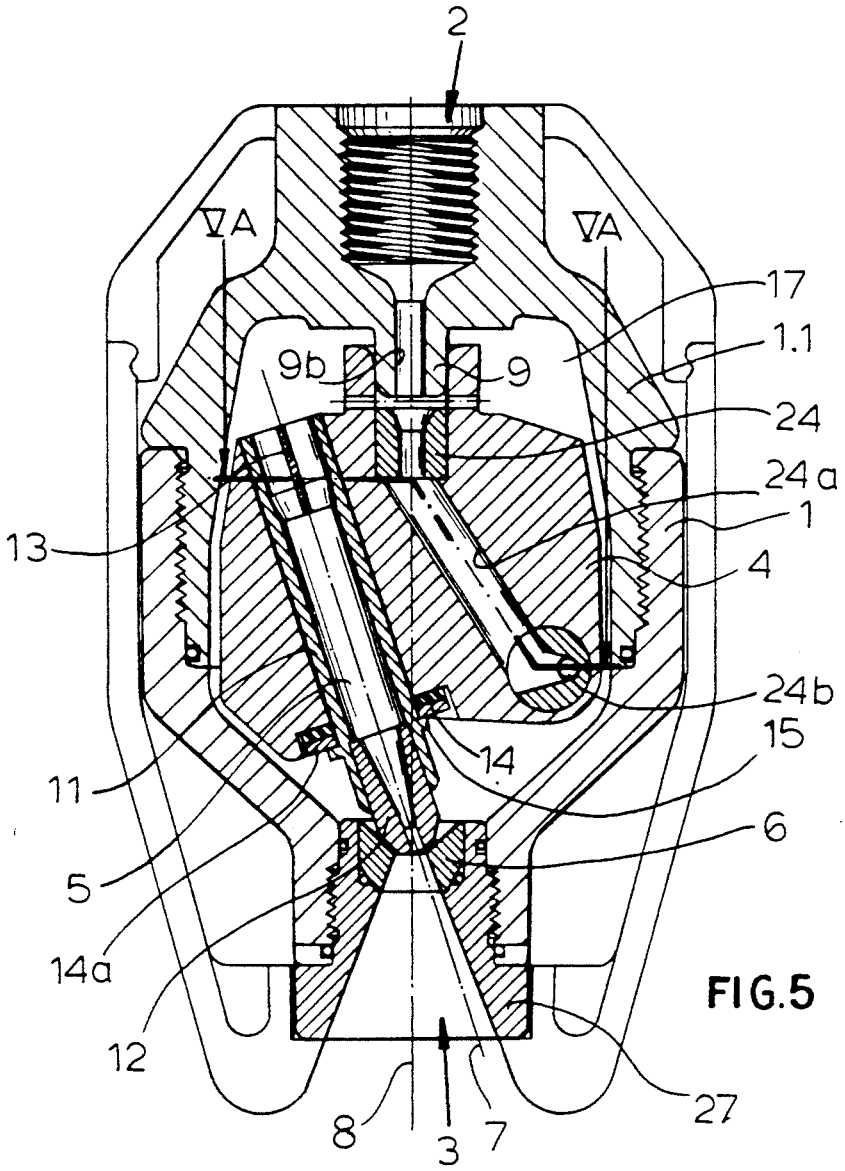
FIG. 5 is a longitudinal section through still another embodiment of the invention.

In the embodiment of FIGS. 4 and 5, the pocket bearing 6 is shown to be mounted in inserts 27 which are threaded into the nozzle housing 1 and can be axially adjustable therein.

The axial adjustment by reason of the screw thread of the insert 27 makes it possible to shift the rotor body 4 axially in the housing to a certain degree and with a corresponding construction of the inlet 2, this can adjust the speed of the rotary body 4. This axial adjustment of the rotor body can effect a change in the proportion of the cleaning liquid which serves to dry the rotor body.

The embodiment of FIG. 4 corresponds basically to that of FIG. 2 except that here a bent tube segment 50 is injection molded into the rotor body 4 which is otherwise constituted of injection-molded plastic. A die-cast structure can also be used. The tube segment 50 has an axial portion 50*a* which is aligned with a bore 9*b* coaxially formed in the stub 9 and which runs into a portion 50*b* extending radially into a tangential portion 50*c* opening into the annular chamber 17 around the body 4. When the liquid flows into and through this tube segment 50, it emerges in the space below an annular shoulder 25 to drive the body 4 in rotation about the axis 8 by the reaction principle.

The tube segment 50 can be only clamped or swaged in the body 14 if desired.

The annular shoulder 25 forms a gap 25*a* with the inner wall of the cover portion 1.1 of the housing 1 and into the annular space 17 above this shoulder 25, a passage or bore 26 can open from the bore 9*b* to supply the cleaning liquid to the steps 17 from which it passes into the nozzle 5.

The width of gap 25*a* may be adjusted by moving the body 4 axially along the frustoconical surface 1.1*a* of the housing by, for example, threading the insert 27 more or less deeply into the housing 1. The insert 27 carries the pocket bearing 6.

Liquid can also enter the chamber 17 from the space below the shoulder 25 through the gap 25*a* and, in passing through the gap, undesirable turbulence and vortices are neutralized so that the flow into and within the nozzle 5 is a laminar flow. The jet supplied by the nozzle assembly of FIG. 4 is of especially high quality and sharply bundled because of the elimination of turbulence in the nozzle.

Since all types of impingement of cleaning liquid entering through the stub 9 upon the rotor body 4 are eliminated, an especially low wear operation is obtained. Furthermore, the reverse flow of liquid through the gap 25*a* has been found to be advantageous as well.

The rotor body also has an annular shoulder 28 which precenters the rotor body when it is inserted into the housing, thereby avoiding damage to the nozzle 5 when the externally-threaded cover part 1.1 is screwed into the internally-threaded remainder of the housing 1 to the insertion of the body 4 is facilitated by rounding the edge 29*a* of the annular surface 29 surrounding the lower portion of member 4.

The embodiment of FIGS. 5 and 5A differs from that of FIG. 1 in that the rotor body 2 has a substantially round configuration in cross section and the passage of the stub 9 opens into a nozzle 24 which has the same cross section or a somewhat smaller cross section than the passage 9*b* in the stub 9. In this case, a tangential outlet is molded into the body 4 and a bore 24*a* connects the nozzle 24 with the tangential passage 24*b*.

Figure 6:
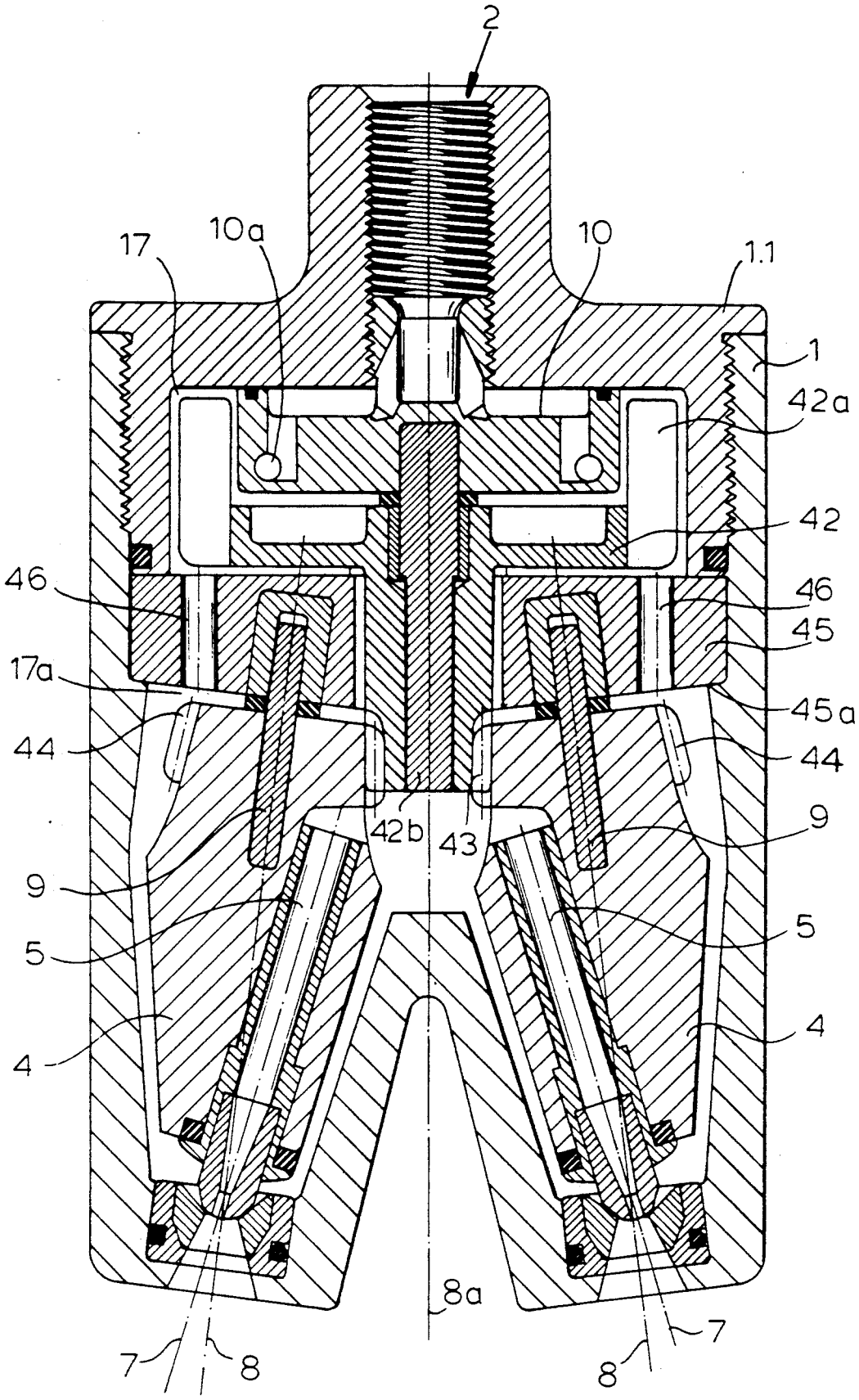
FIG. 6 is an axial section of a double jet nozzle according to the invention.

In the embodiment of FIG. 6, a rotor nozzle is illustrated which is intended for very high volume rates of flow. In this embodiment, a deflector 10 is provided at the inlet 2 of the cover portion 1.1 of the housing 1 and has tangential ports 10*a* which discharge the cleaning liquid into a chamber 17 provided with a turbine wheel 42 whose blades are represented at 42*a*.

In this case, two rotor bodies 4 are provided, each with a pinion 44 meshing a sun gear 43 formed on the turbine wheel 42. The two rotor bodies are disposed mirror-symmetrically about the axis 8*a* of rotation of the turbine. The turbine is rotatable on a shaft 42*b* fixed in the deflector 10 which, in turn, is fixed in the housing part 1.1.

The liquid driving the blades 42*a* can then pass via bores 46 in a ring 45 seated on a shoulder 45*a* of the housing into a chamber 17*a* from which the liquid can enter the nozzles 5 of the rotor bodies.

The symmetrical construction prevents the development of transverse forces which make it difficult to hold the rotor nozzle assembly even when the speeds of the rotor bodies 4 is low or rotation thereof is blocked.

The rotor bodies 4 are journaled on respective pins or stubs 9 mounted in the intermediate member 45 or flange.

In this case, two conical jets 7 are generated around respective axes 8.

Figure 7:
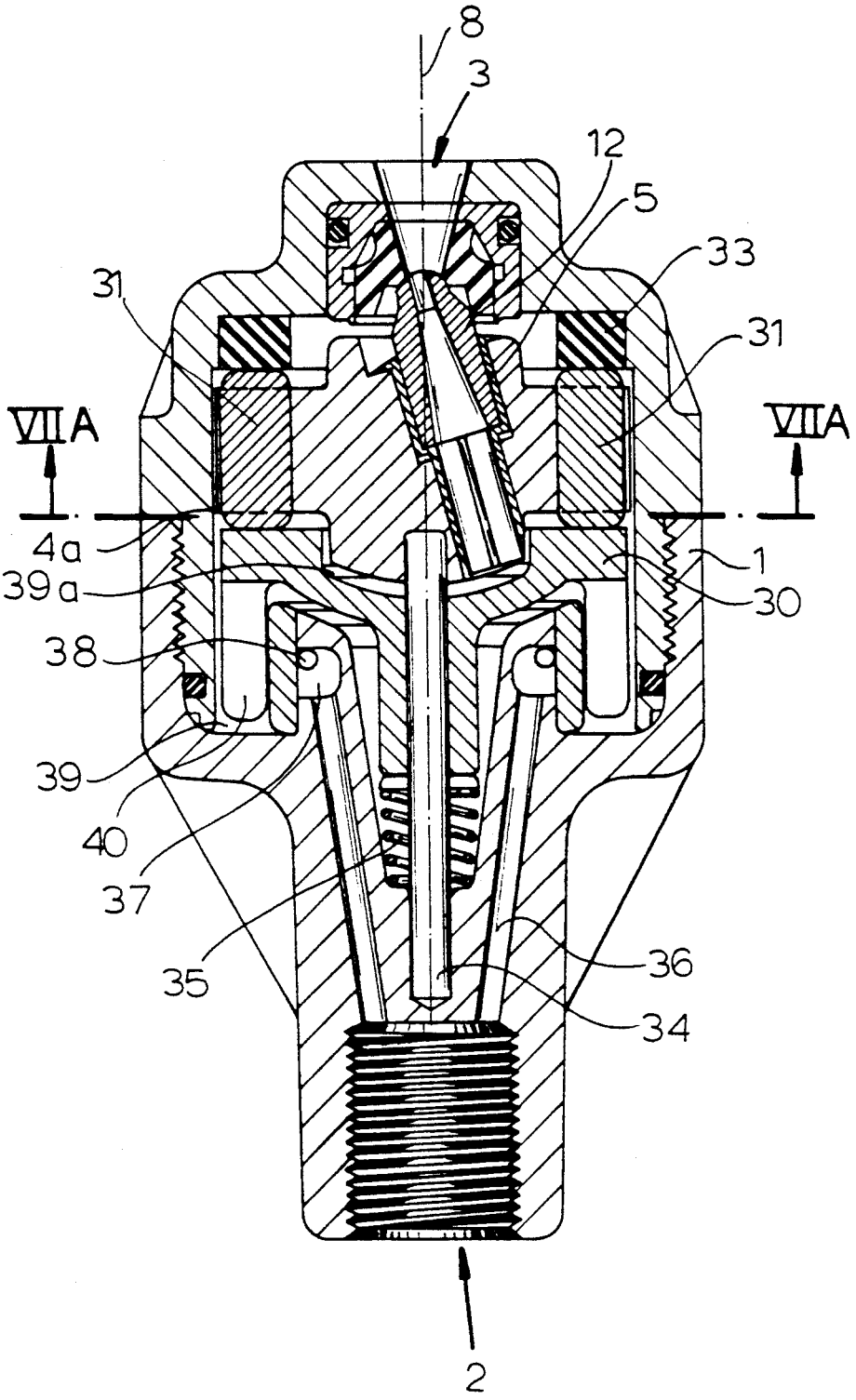
FIG. 7 is an axial section through an embodiment of the invention in which the journaling of the rotor body is effected in part via rollers.
Figure 8:
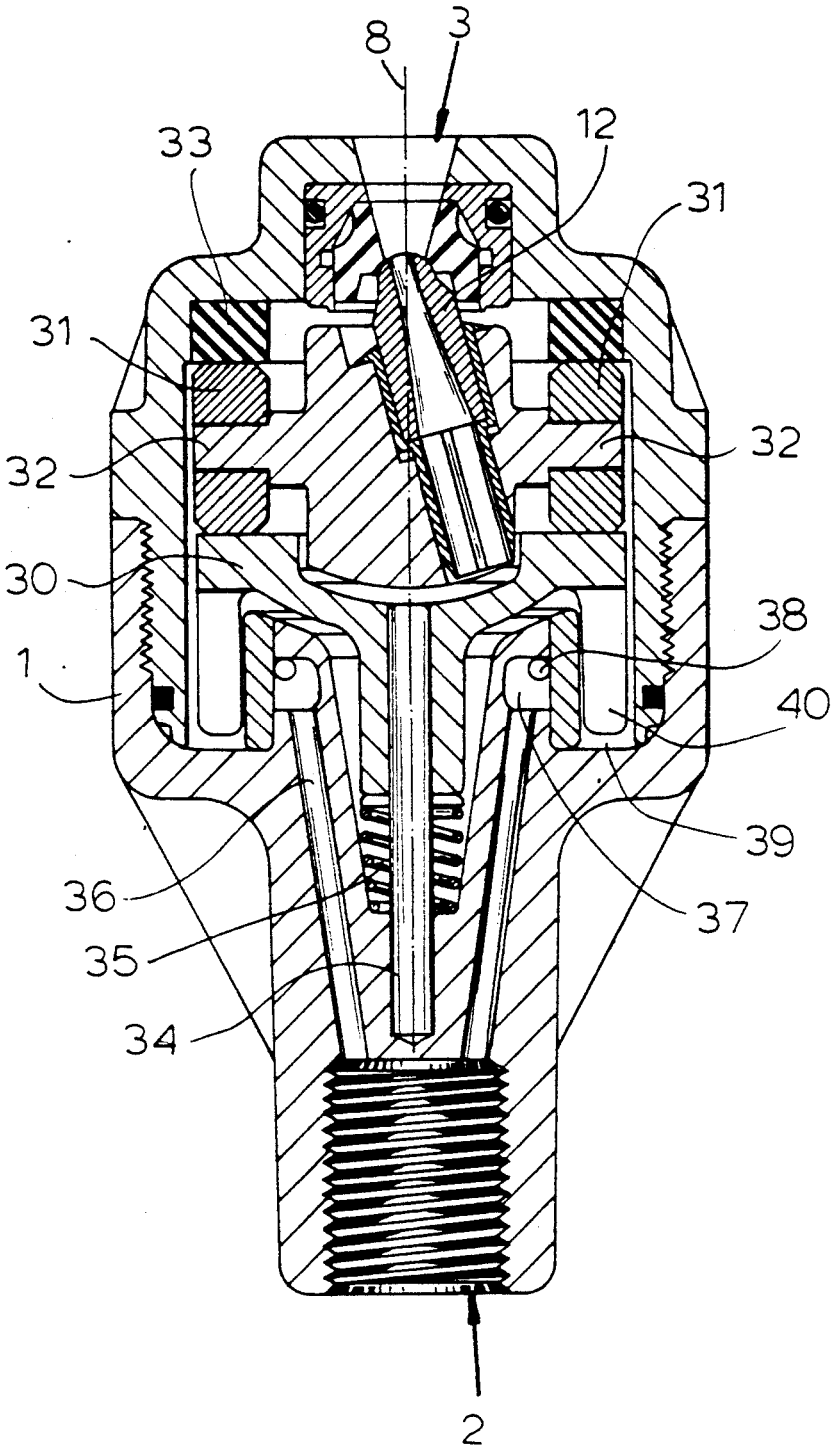
FIG. 8 is an axial section representing a slight modification of the embodiment of FIG. 7.

FIGS. 7 and 8 show nozzle structures in which the flow from inlets 2 drives a turbine wheel 30 which bears against rollers 31 entraining the respective rotor body 4 about the axis 8.

The turbine wheels 30 are rotatable about the axes 8 and are driven by the cleaning liquid. The cleaning liquid then flows through bores 36 into an annular passage 37 and thence through substantially tangential bores 38 into an annular space 39 in which the blades 40 of the turbine 30 are mounted. From the space 39, the liquid can pass between the rollers 31 into a space 39 to enter the nozzle 5.

The end face of the turbine wheel 30 turned toward the rotor body 4 forms a race for the rollers 31 which are mounted on the rotor body 4. The rotation of the turbine wheel 30 thus drives the rollers and hence rotates the body 4 with a step-down in the rotary speed of the rotor 4 relative to the speed of the turbine wheel.

The rollers 31 can, as seen in FIG. 7, be mounted in recesses 4*a* of the rotor body 4. As can be seen from FIG. 8, as an alternative, each roller 31 can be mounted on a radial arm 32 of the rotor body 4.

The roller bodies 31 bear against a bearing ring 33 on the side of the housing opposite the inlet 2 and provided with the orifice 3, the material and properties of this ring 33 being selected with respect to the characteristics of the roller 31 to minimize slip and wear between them.

The turbine wheel 30 is journaled on an axial shaft 34 of the nozzle housing 1. In the embodiment of FIG. 8, this shaft does not extend into the rotor body 4 beyond the turbine wheel 30.

In the embodiment of FIG. 7, however, the shaft 34 extends through the turbine wheel 30 into the rotor body 4 and forms an additional journal for the latter.

The turbine wheel 30 is pressed by a coil spring 35 against the rollers 31 of the rotor body 4, the coil spring 35 being braced against the nozzle housing 1.

Figure 9:
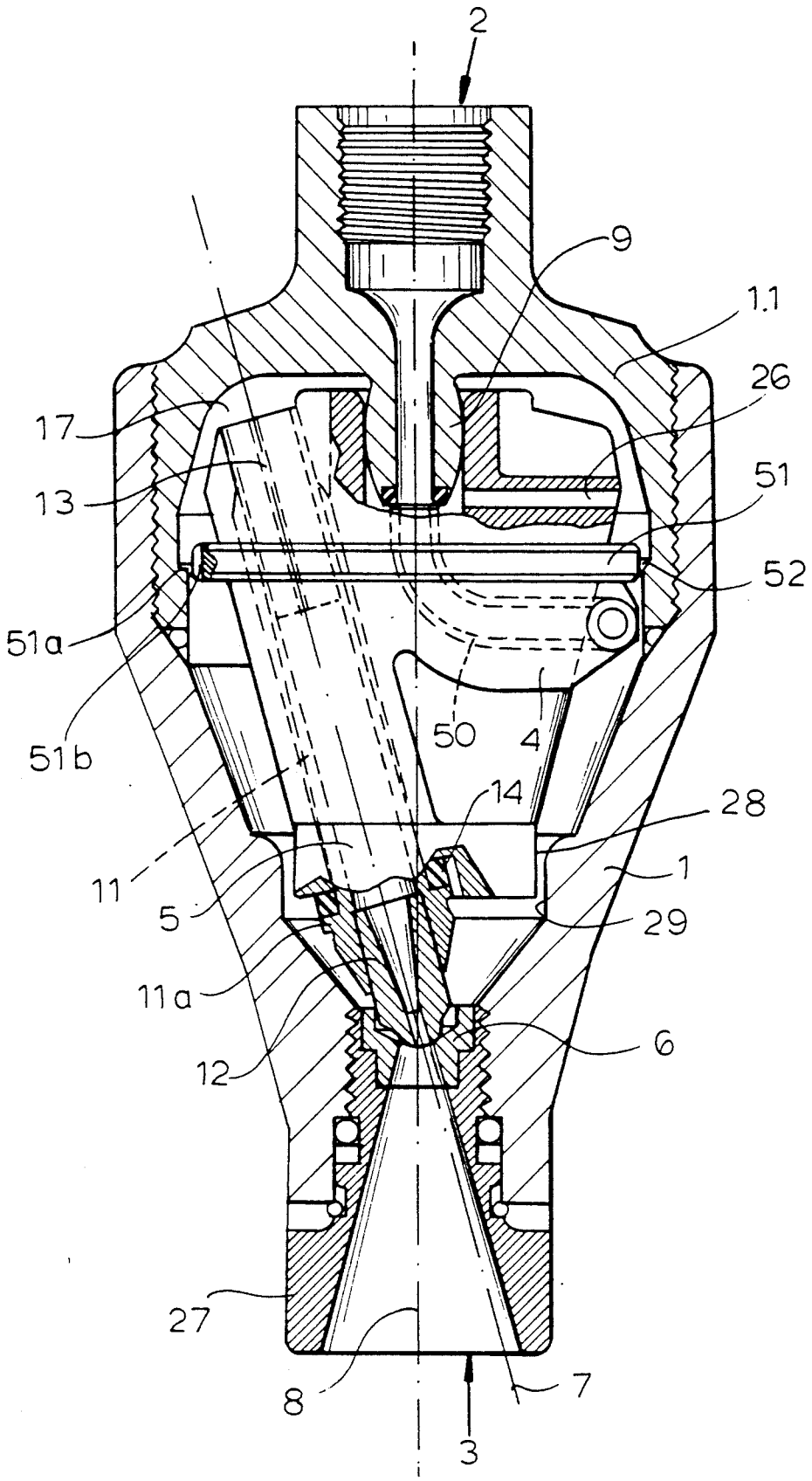
FIG. 9 is an axial section through an embodiment similar to that of FIG. 4.

In the embodiment of FIG. 9, the nozzle housing 1 is formed on its inner surface with a conically converging annular surface 51 tapering toward the outlet orifice. The rotor body 4 here is provided with an annular shoulder 52 which reaches toward the annular surface 51 to define an annular gap therewith of a width dependent upon the axial position of the rotor body 4.

The result is a floating bearing for the rotor body 4. This floating bearing establishes an equilibrium between the leakage liquid on one side while the other side is traversed by the cleaning liquid.

The annular gap 51*a* can be provided with an axial slot 51*b* (FIG. 9) to allow contaminants to clear through.

In this embodiment as well, the pocket bearing 6, in which the tip of the nozzle 5 is received, is mounted in a threaded insert 27 which can be screwed to a greater or lesser depth into the housing 1, thereby adjusting the position of the rotor body 4. In this embodiment, moreover, the resilient cushion 14 is braced between a shoulder 11*a* of the sleeve 11 of the nozzle 5 and the rotor body 4, cushioning the rotor body with respect to the pocket bearing 6 and the orifice end of the housing.

A similar cushion is provided at 14 in the embodiment of FIG. 3 and the embodiment of FIG. 4. In FIG. 5, a resilient washer 14 is disposed between a metal washer 14*a* and the rotor body 4, the metal washer 14*a* engaging the shoulder 15. A similar construction is provided in FIG. 2.

In all of the embodiments described, the two part housing can be radially opened by unscrewing the cover part of the housing from the remainder thereof. Then the rotor 4 or rotors 4 and the nozzles 5 forming a unit therewith can be simply removed and replaced.

I claim:

1. A rotor nozzle assembly for a high-pressure cleaning apparatus, comprising:

a nozzle housing defining a rotation axis, an outlet orifice along said axis at one end of said housing, and an inlet for a cleaning liquid at an opposite end of said housing;

a rotor body in said housing rotatable about said axis;

an elongated nozzle rigidly fixed in said rotor body and having an outlet end proximal to said orifice and an inlet end communicating with said inlet and remote from said orifice, said nozzle being oriented at an acute angle to said axis to generate a jet emerging from said orifice with a conical configuration upon rotation of said rotor body about said axis;

a pocket bearing in said housing surrounding said orifice, said outlet end of said nozzle engaging said pocket bearing; and means in said housing for journaling said rotor body on a part of said housing opposite said orifice in a one-sided journal.

2. The rotor nozzle assembly defined in claim 1 wherein said means in said housing for journaling said rotor body on a part of said housing opposite said orifice in a one-sided journal includes a stub formed on said housing and journaling said rotor body.

3. The rotor nozzle assembly defined in claim 2 wherein said housing has a cover removable from a remainder of said housing and forming said part, said stub projecting from said cover.

4. The rotor nozzle assembly defined in claim 3 wherein said cover is formed with a deflector receiving said liquid from said inlet and directing said liquid outwardly, said deflector being fixed to said cover and said stub being mounted on said deflector.

5. The rotor nozzle assembly defined in claim 2 wherein said stub is formed with a coaxial bore communicating with said inlet, said rotor body being formed with a tube segment having an axially extending portion communicating with said bore, a radial portion extending outwardly from said axially extending portion and a tangential portion connected with said radial portion and discharging said liquid to drive said rotor body.

6. The rotor nozzle assembly defined in claim 5 wherein said tube segment is manufactured within said rotor body.

7. The rotor nozzle assembly defined in claim 2 wherein said stub is a cylindrical pin.

8. The rotor nozzle assembly defined in claim 2 wherein said stub is conically tapered toward a free end thereof.

9. The rotor nozzle assembly defined in claim 2, further comprising a resilient member damping axial play of said rotor body between said pocket bearing and said stub.

10. The rotor nozzle assembly defined in claim 9 wherein said resilient member is an elastic ring braced between a radially projecting annular flange on a sleeve part of said nozzle and the end face of said rotor body juxtaposed with said orifice.

11. The rotor nozzle assembly defined in claim 1 wherein said rotor body extends substantially over an entire length of said housing.

12. The rotor nozzle assembly defined in claim 1, further comprising a turbine wheel in said housing driven by said liquid and having an annular surface facing said rotor body, said rotor body being formed with a plurality of rollers riding on said annular surface.

13. The rotor nozzle assembly defined in claim 12 wherein said rollers are received in peripheral recesses formed in said rotor body.

14. The rotor nozzle assembly defined in claim 12 wherein said rollers are journaled on radial arms formed on said rotor body.

15. The rotor nozzle assembly defined in claim 12, further comprising a bearing ring in said housing, said rollers riding on said bearing ring.

16. The rotor nozzle assembly defined in claim 12, further comprising an axial shaft on said nozzle housing and upon which said turbine wheel is journaled.

17. The rotor nozzle assembly defined in claim 16 wherein said shaft extends into said rotor body.

18. The rotor nozzle assembly defined in claim 12, further comprising a coil spring bearing upon said turbine wheel and urging said turbine wheel against said rollers.

19. The rotor nozzle assembly defined in claim 1 wherein said nozzle is received in a cylindrical bore in said rotor body.

20. The rotor nozzle assembly defined in claim 1 wherein said nozzle is formed as a sleeve having a nozzle tip at said outlet end and provided at said inlet end with vanes limiting turbulent flow.

21. The rotor nozzle assembly defined in claim 1 wherein said pocket bearing is received in an insert axially adjustable and threaded into said housing.

22. The rotor nozzle assembly defined in claim 1 wherein said housing has a frustoconical inner surface juxtaposed with an annular radial projection on said rotor body defining a gap of a width which is adjustable with adjustment in an axial position of said rotor body.

23. The rotor nozzle assembly defined in claim 22 wherein said projection is formed with an axially extending cutout for clearing contaminants.

24. The rotor nozzle assembly defined in claim 1 wherein said housing has a vortex chamber and means communicating with said inlet for directing a stream of said cleaning liquid tially into said chamber to generate a swirl of said liquid therein, said body having a projection extending into said vortex chamber and of a length less than a full height thereof for entrainment with said swirl to rotate said body about said axis.

* * * * *